US007679294B1

(12) United States Patent
Xiong et al.

(10) Patent No.: US 7,679,294 B1
(45) Date of Patent: Mar. 16, 2010

(54) METHOD AND SYSTEM TO ELIMINATE FLUORESCENT LAMP STRIATIONS BY USING CAPACITIVE ENERGY COMPENSATION

(75) Inventors: Wei Xiong, Madison, AL (US); Christopher Radzinski, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 75 days.

(21) Appl. No.: 11/950,743

(22) Filed: Dec. 5, 2007

(51) Int. Cl.
*H05B 37/02* (2006.01)

(52) U.S. Cl. ..... 315/224; 315/185 R; 315/275; 315/209 R; 315/290

(58) Field of Classification Search ..... 315/224, 315/225, 119, 127, 185 R, 188, 193, 194, 315/199, 232, 237, 238, 240, 241 R, 245, 315/273, 275, 289, 290, 209 R, 276, 274
See application file for complete search history.

(56) References Cited

U.S. PATENT DOCUMENTS

| | | | | |
|---|---|---|---|---|
| 5,001,386 | A | 3/1991 | Sullivan et al. | |
| 5,034,660 | A | 7/1991 | Sairanen | |
| 5,173,643 | A | 12/1992 | Sullivan et al. | |
| 5,192,896 | A | 3/1993 | Qin | |
| 5,369,339 | A | 11/1994 | Reijnaerts | |
| 5,596,247 | A | 1/1997 | Martich et al. | |
| 5,691,606 | A | 11/1997 | Moisin et al. | |
| 5,701,059 | A * | 12/1997 | Steigerwald et al. | 315/219 |
| 5,729,095 | A | 3/1998 | Shimokawa et al. | |
| 5,760,541 | A | 6/1998 | Stavely et al. | |
| 5,798,617 | A | 8/1998 | Moisin | |
| 5,821,699 | A | 10/1998 | Moisin | |
| 5,841,239 | A | 11/1998 | Sullivan et al. | |
| 5,864,212 | A | 1/1999 | Sullivan | |
| 5,955,841 | A | 9/1999 | Moisin et al. | |
| 5,961,204 | A | 10/1999 | Martich et al. | |
| 5,982,111 | A | 11/1999 | Moisin | |
| 5,994,843 | A | 11/1999 | Kataoka et al. | |
| 6,069,453 | A | 5/2000 | Arts et al. | |
| 6,087,785 | A | 7/2000 | Hsieh | |
| 6,400,097 | B1 | 6/2002 | Jin et al. | |
| 6,465,972 | B1 | 10/2002 | Kachmarik et al. | |
| 6,756,747 | B2 | 6/2004 | Hsieh | |
| 6,836,077 | B2 | 12/2004 | Nerone | |
| 6,963,176 | B2 | 11/2005 | Onishi et al. | |
| 2004/0085031 | A1 | 5/2004 | Hsieh | |
| 2005/0168171 | A1 | 8/2005 | Poehlman | |
| 2007/0176564 | A1 * | 8/2007 | Nerone et al. | 315/209 R |

* cited by examiner

*Primary Examiner*—Tuyet Vo
(74) *Attorney, Agent, or Firm*—Waddey & Patterson; Mark J. Patterson

(57) ABSTRACT

A method and system for reducing and/or eliminating striations from gas discharge lamps powered by an electronic ballast charges a capacitive energy device, which is coupled in parallel with the lamp, when the capacitive energy device detects that a predetermined lamp voltage condition has been satisfied. The system/method supplements the current supplied to the lamp by the electronic ballast with current supplied from the capacitive energy device when the predetermined lamp voltage condition is not satisfied. The supplemental current supplied to the lamp creates a harmonic-rich lamp current waveform that reduces and/or eliminates striations.

17 Claims, 4 Drawing Sheets

METHOD AND SYSTEM TO ELIMINATE FLUORESCENT LAMP STRIATIONS BY USING CAPACITIVE ENERGY COMPENSATION

BACKGROUND OF THE INVENTION

The present invention relates generally to electronic ballasts used for operating gas discharge lamps. More particularly, the present invention pertains to methods and systems for eliminating striations in gas discharge lamps.

A fluorescent lamp is a type of gas discharge lamp having a fluorescent phosphor coating the inside surface of the lamp's sealed tube. The tube may contain a small amount of mercury and an inert gas such as argon. Both ends of the tube have electrodes, often made of tungsten. Initially, as power is delivered to the lamp, the electrodes become thermally agitated and emit electrons. These electrons impact and ionize the inert gas in the tube which results in the formation of a plasma (a phase of matter different from solid, liquid, or gas that readily facilitates current conduction because of its low impedance).

The current now flowing between the electrodes, as a result of the potential difference between the electrodes and the plasma, cause the mercury to ionize and release ultraviolet radiation. The ultraviolet radiation is absorbed by the phosphor coating and, then, the phosphor coating radiates in the visible light spectrum, i.e. produces visible light waves. Through this process the fluorescent lamp efficiently converts electrical energy into visible light.

It is important to recognize that the current flowing between the electrodes of the lamp changes direction as a result of the alternating current (AC) supplied by the ballast to the lamp. Thus, current flows in one direction for a period of time and then in the opposite direction for another period of time. The time in which the current flows in one direction is related to the frequency. This process is controlled by the ballast and is constantly repeated during the operation of the lamp.

Without the use of alternating current and the ballast, the operation of the lamp would not be feasible. Consider that the plasma formed in the tube is analogous to an electrical short circuit. If the current only flowed in one direction the current demanded by the lamp would become enormous after only a short time. But using an alternating current only allows the current flowing through the lamp to build for a short period of time before it reverses direction and flows the other way (depending on the current's frequency). Further consider that in order for the current to reverse its direction, it must first come to a stop before it changes direction. In this way, the current demanded by the lamp and conducted through the plasma (essentially a short circuit) is prohibited from building to an unmanageable level.

Although the use of alternating current greatly facilitates the operation of gas discharge lamps, one undesirable consequence associated with such use is a phenomenon known as striations. Striations are shifting zones of light intensity appearing as dark and light bands along the length of the tube and result, in part, from the alternating nature of the current supplied to the lamp. Sometimes the striations appear as standing waves and sometimes they appear as propagating along the length of the lamp tube. Striations produce a visible strobing effect that is objectionable to many persons.

For exemplary purposes, striations can be considered in terms of the interaction between the visible light waves emitted from the lamp. Light waves are emitted according to the alternating current flowing through the lamp. If the current flowed through the lamp at a single frequency, it is more probable that light waves would interact to produce striations because there is a higher probability that the troughs and crests of the various waves, having identical frequencies, would align (thereby creating striations). However, if the current waveform flowing through the lamp contained many frequencies, i.e. the current waveform was rich in harmonics, it is less probable that noticeable striations would occur. This conclusion logically follows as waves with different frequencies have troughs and crests occurring at disparate rates and for disparate durations and these distinctions make it less likely that the troughs and crests will interfere to produce striations.

Various attempts have been proffered in the prior art to eliminate or reduce the occurrence of striations. For example, U.S. Pat. No. 5,001,386 issued to Sullivan, et al. and U.S. Pat. No. 5,864,212 issued to Sullivan disclose a dimming circuit that reduces striations by introducing an asymmetric current waveform flowing through the lamp. The asymmetric current results from a DC offset being provided along with the alternating current source.

U.S. Pat. No. 5,034,660 issued to Sairanen and U.S. Pat. No. 5,369,339 issued to Reijnaerts teach eliminating striation by inducing a direct current component within the lamp input signal. This component is introduced where the circuit design mandates that the current amplitude in one direction is necessarily higher than in the other.

U.S. Pat. No. 5,760,541 issued to Stavely, et al. describes improving longitudinal stability of intensity striations within a fluorescent lamp by causing periodic non-uniformity in the electric field between two electrodes.

U.S. Pat. No. 5,994,843 issued to Kataoka, et al. teaches preventing striation through asymmetric current flow, such asymmetry being introduced by setting the capacities of alternately charged energy accumulating capacitors to slightly different levels.

U.S. Pat. No. 6,069,453 issued to Arts, et al. discloses a ballast circuit for reducing striations by generating a lamp current comprised in part of a direct current component.

U.S. Pat. No. 6,087,785 issued to Hsieh teaches a strategy to break up elements that cause striations, in this case acoustic resonance, by modulating lamp current with a harmonized circuit to uniformly spread lamp energy into every harmonic.

U.S. Pat. No. 6,465,972 issued to Kachmarik, et al. describes a lighting system for a gas discharge lamp that eliminates striations by periodically modulating the amplitude of the lamp input signal prior to being received by the lamp.

U.S. Pat. No. 6,756,747 issued to Hsieh and U.S. Patent Application 20040085031 filed by Hsieh disclose a method for reducing striations in a fluorescent lamp by producing and alternately modulating a pair of complementary pulse trains in light of control signals that render the pulse trains asymmetrical at voltages where striation is most likely.

U.S. Pat. No. 6,836,077 issued to Nerone teaches eliminating visual striations with an asymmetric alternating lamp input current. Such a current is produced by configuring an inverting ballast circuit with complementary switches having unbalanced on times.

U.S. Pat. No. 6,963,176 issued to Onishi, et al. describes a method of suppressing striations by superimposing a pulse voltage to the voltage applied across a discharge lamp after lighting has started.

U.S. Application No. 20050168171 filed by Poehlman discloses a method for controlling striations by generating asymmetric lamp current with an unbalanced circuit component in the electronic ballast and subsequently supplying that current to the lamp.

In summary, the prior art discussed above discloses a variety of methods for reducing or eliminating striations in gas discharge lamps, most of which include either inducing or injecting a direct current component in the lamp current, modulating the amplitude of the current waveform, or creating an asymmetric frequency by modulating switch times on the inverter. The prior art discussed above also teaches eliminating acoustic resonance by spreading the harmonic energy in the lamp with a load circuit designed to generate compensating currents and modulate the lamp input current.

Although the prior art is replete with attempts to reduce or eliminate striations, none of the prior art teaches a method of operating a gas discharge lamp to eliminate striations that includes capacitive energy compensation to the lamp. What is needed, then, an effective, simple, and efficient method and system to significantly reduce and/or eliminate striations in gas discharge lamps by introducing harmonics into the current waveform by capacitive energy compensation.

BRIEF SUMMARY OF THE INVENTION

The present invention is a method and system for reducing and/or eliminating striations from gas discharge lamps. The invention is a system and method of eliminating striations in a lamp powered by an electronic ballast by charging a capacitive energy device, which is coupled in parallel with the lamp, when the capacitive energy device detects that a predetermined lamp voltage condition has been satisfied. The method further includes supplementing the current supplied to the lamp by the electronic ballast with current supplied from the capacitive energy device when the predetermined lamp voltage condition is not satisfied. The supplemental current supplied to the lamp creates a harmonic-rich lamp current waveform that reduces and/or eliminates striations.

The capacitive energy device includes a capacitor, a diode, and a resistor. In response to a predetermined lamp voltage condition, the diode will conduct thereby allowing the capacitor to charge. After a period of charging, the predetermined lamp voltage condition will end and the diode will cease to conduct. When this occurs, the capacitor will begin to discharge through both the lamp and the resistor. The current discharged from the capacitor to the lamp will supplement the current provided by the ballast. The aggregation of the supplemental current from the capacitor and the current from the ballast will produce a harmonic-rich waveform. The harmonic-rich waveform will reduce or eliminate striations as any striation precipitating events will be spread across a larger frequency spectrum—and, consequently, are less likely to be observable.

Accordingly it is an object of the invention to provide a method for reducing or eliminating striations in gas discharge lamps.

It is another object of the invention to provide a system for reducing or eliminating striations in gas discharge lamps.

It is yet another objective of the invention to reduce or eliminate striations by providing capacitive energy compensation to the lamp.

It is a final object of the invention to provide a system and method for reducing or eliminating striations in gas discharge lamps in an energy efficient manner.

DETAILED DESCRIPTION OF THE INVENTION

Figure 1:
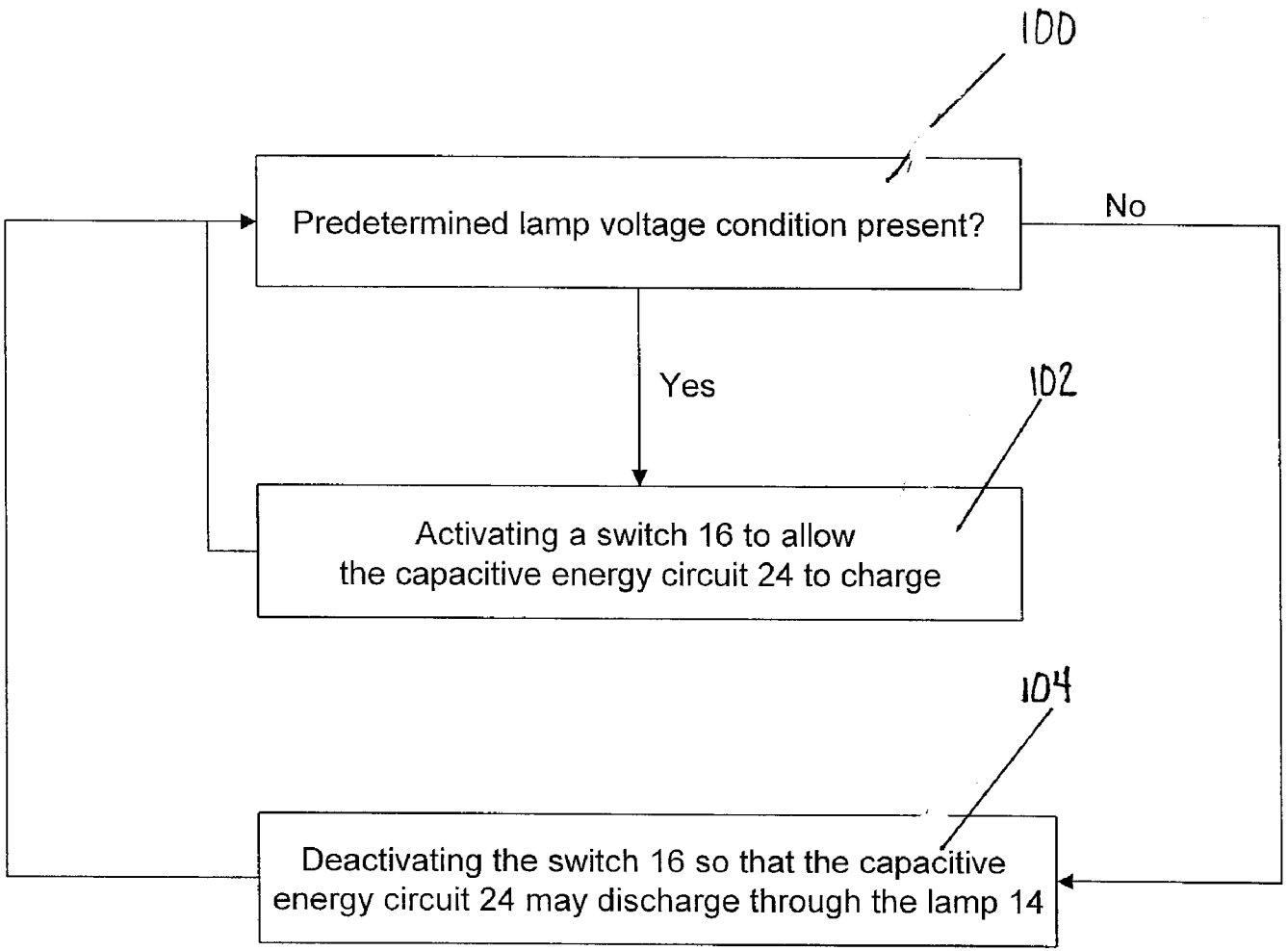
FIG. 1 is a flow chart describing a sequence of steps implemented by the invention to reduce and/or eliminate striations in the lamp.

The present invention is directed toward a system and method for reducing and/or eliminating striations from gas discharge lamps that overcomes the aforementioned deficiencies of the prior art. Namely, by providing capacitive energy compensation to the lamp to create a harmonic-rich current waveform. A harmonic-rich waveform is less susceptible to generating striations than sinusoidal waveforms. FIG. 1 represents an overview of the sequence of steps in which the method of the invention reduces or eliminates entirely striations from gas discharge lamps.

Firstly, and as depicted in step 100, the method includes assessing whether a lamp voltage condition is present. Step 102 shows that if the lamp voltage condition is detected then a switch 16 will activate and allow the capacitive energy circuit 24 to charge, from current supplied by the inverter. Conversely, if the lamp voltage condition is not detected, then step 104 instructs the switch 16 to deactivate (or remain deactivated) which will permit the capacitive energy circuit 24 to discharge through the lamp 14. As the capacitive energy circuit 24 is discharging, the system/method will continue to check for the lamp voltage condition and when it is detected, the switch 16 will activate so that the capacitive energy circuit 24 will stop discharging through the lamp 14 and will commence recharging. While the ballast 12 is operating, this cycle will continue.

Figure 4:
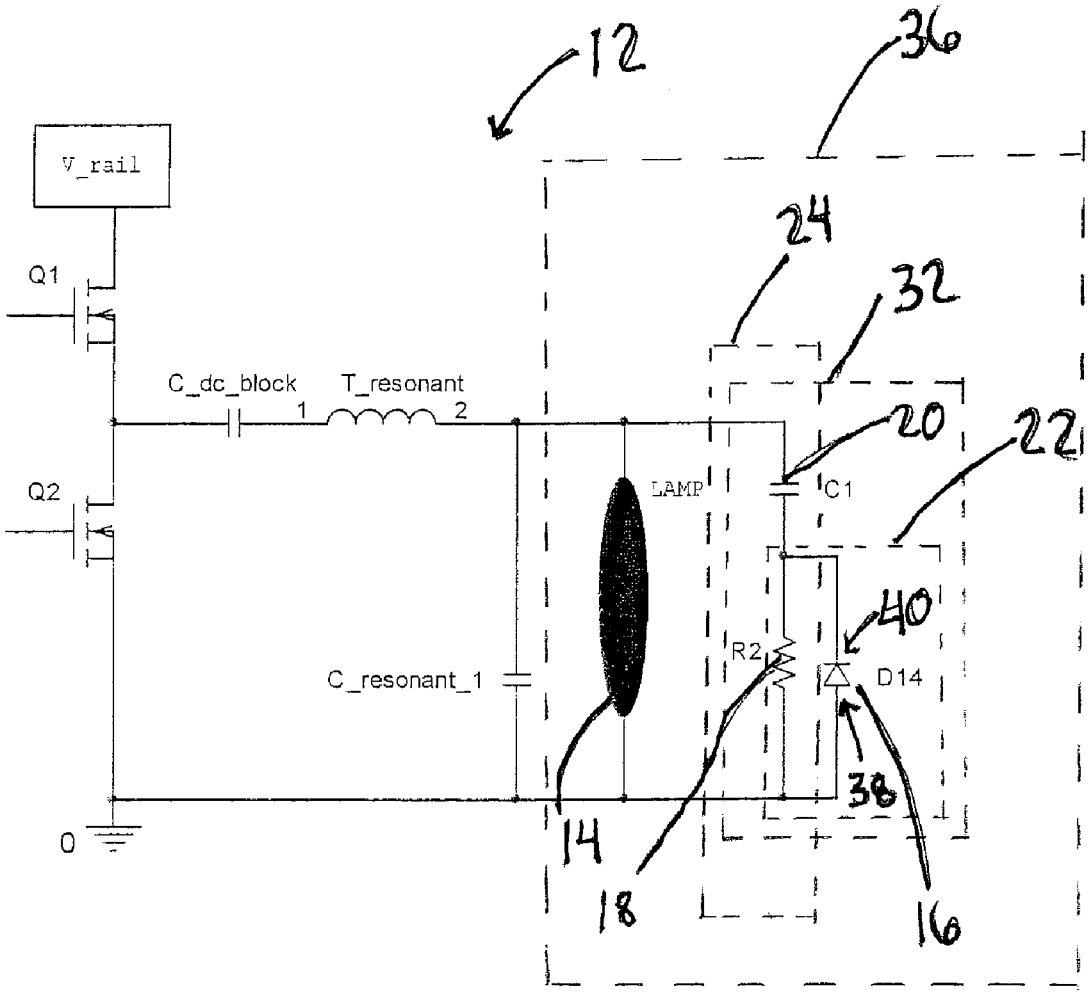
FIG. 4 is a schematic drawing of one embodiment of the present invention.
Figure 5:
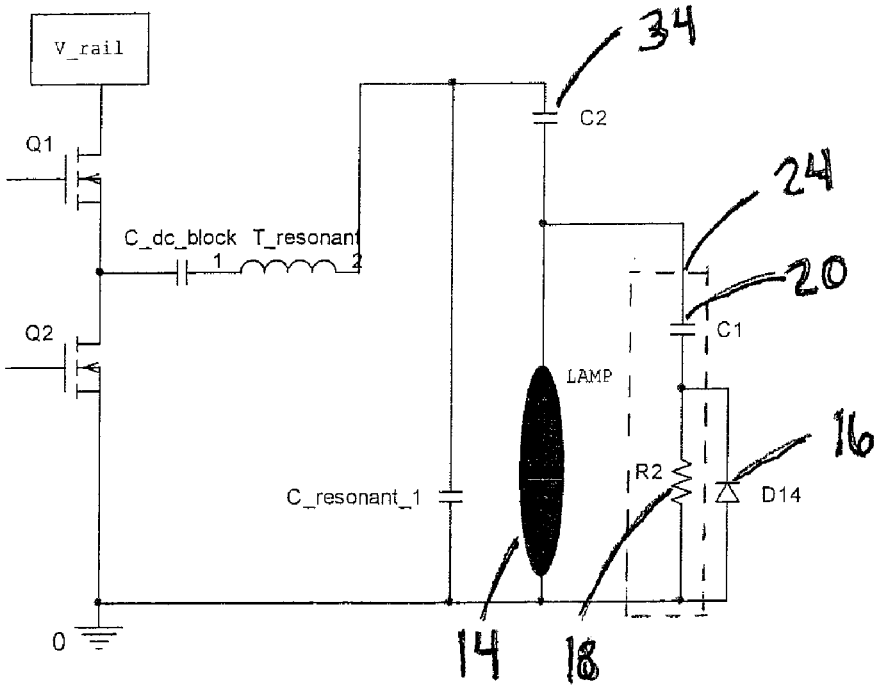
FIG. 5 is a schematic drawing of another embodiment of the present invention.

Referring now to FIGS. 4 and 5, the capacitive energy circuit 24 is operably coupled to the lamp 14. The capacitive energy circuit 24 may include a resistive element 18 and a capacitive energy source 20. Preferably, the resistive element 18 is a resistor 18 and the capacitive energy source 20 is a capacitor 20. Furthermore, the switch 16 may be a diode 16. However, it would be obvious to one of ordinary skill in the art that a myriad of other implementations may serve to satisfy the function of the switch 16, e.g. a transistor. Moreover, the resistive element 18 may include components that provide impendence in addition to resistance.

In one embodiment, shown in FIG. 4, the diode 16 and the resistor 18 are in parallel electrical connection. The circuit defined by the diode 16 and resistor 18 is referred to as the first circuit 22 or switching circuit 22. The capacitor 20 is connected in electrical series with the first circuit 22. Additionally, the diode 16, resistor 18, and capacitor 20 define a striation reduction circuit 32 or a capacitive energy device 32. Preferably, the striation reduction circuit 32 is in parallel electrical connection with the lamp 14. The relationship between the lamp 14 and the striation reduction circuit 32 defines a lighting circuit 36. This configuration engenders the system with the facilities to provide striation reduction and/or elimination to the gas discharge lamp 14.

Figure 2:
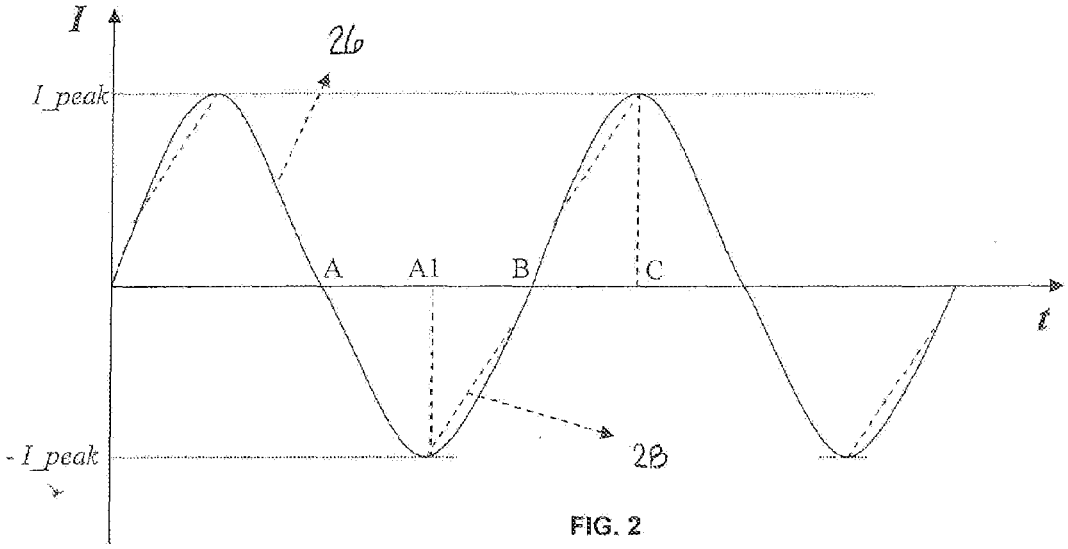
FIG. 2 is a representation of a lamp current waveform with and without capacitive energy compensation.
Figure 3:
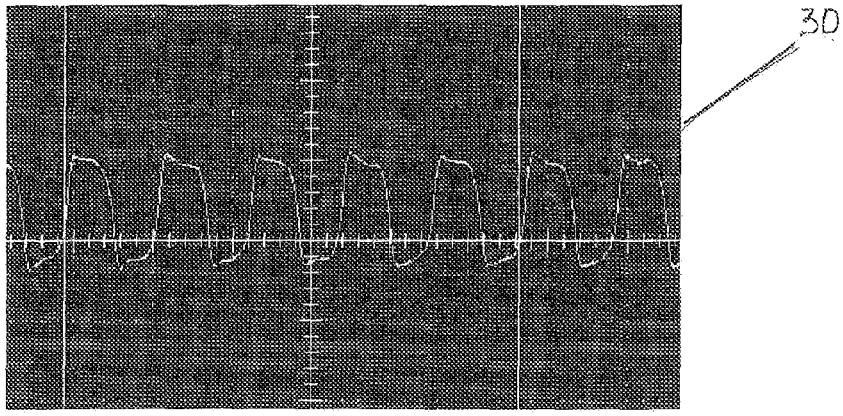
FIG. 3 is shows a harmonic-rich lamp current waveform.

FIG. 2 is a representation depicting the waveforms 26 and 28. Specifically, FIG. 2 illustrates two distinct lamp current waveforms; the lamp current waveform without capacitive energy compensation 26 and the capacitive energy contribution waveform 28. FIG. 3 shows a compensated lamp current waveform 30. The compensated lamp current waveform 30 is the composite formed after the waveform 26 receives contributions from waveform 28, i.e. the waveform 26 is compensated or supplemented with capacitive energy from waveform 28.

Now consider the waveforms 26 and 28 with reference to the ballast circuit 12 in FIG. 4. For exemplary purposes consider that the following scenario occurs during the interval between times A and A1 in FIG. 2. Initially, the diode 16 is forward biased, and able to conduct, during this interval because the anode 38, connected to electrical ground, is presented with a higher potential than the cathode 40, which is connected to the inverter output through the capacitor 20. With the diode 16 conducting, a relatively low impedance path, at least compared to the path from the inverter output to electrical ground through resistor 18, is created from the inverter output through the capacitor 20 and the diode 16 to electrical ground.

This low impedance path facilitates the process of charging the capacitor 20 (the period during which the capacitor 20 is charging is referred to as the first portion of the periodic lamp current). The interval in which the diode 16 is forward biased, and hence conducting, satisfies the predetermined lamp voltage condition or predetermined signal event—a designation to indicate the diode 16 is conducting.

It should be noted that the above-described sequence may not strictly occur between time A and A1—some tolerance is dictated by the strictures of physical implementation(s). In some instances, the first portion of the periodic lamp current and events satisfying the predetermined lamp voltage condition may align. While in other instances the two may temporally differ relative to one another due to factors such as, but not limited to, phase differences between the current and voltage waveforms or charging/discharging delays associated with the capacitor 20. However, regardless of these slight differences the system would still effectively function to reduce or eliminate striations.

Now turn to the period from A1 to C as shown in FIG. 2. During this period the diode 16 is no longer forward biased and stops conducting. At point A1, the voltage across the capacitor 20 is equal to the voltage across the lamp. As such, the potential difference between the anode 38 and the cathode 40 of diode 16 is insufficient to bias the diode 16.

Figure 6:
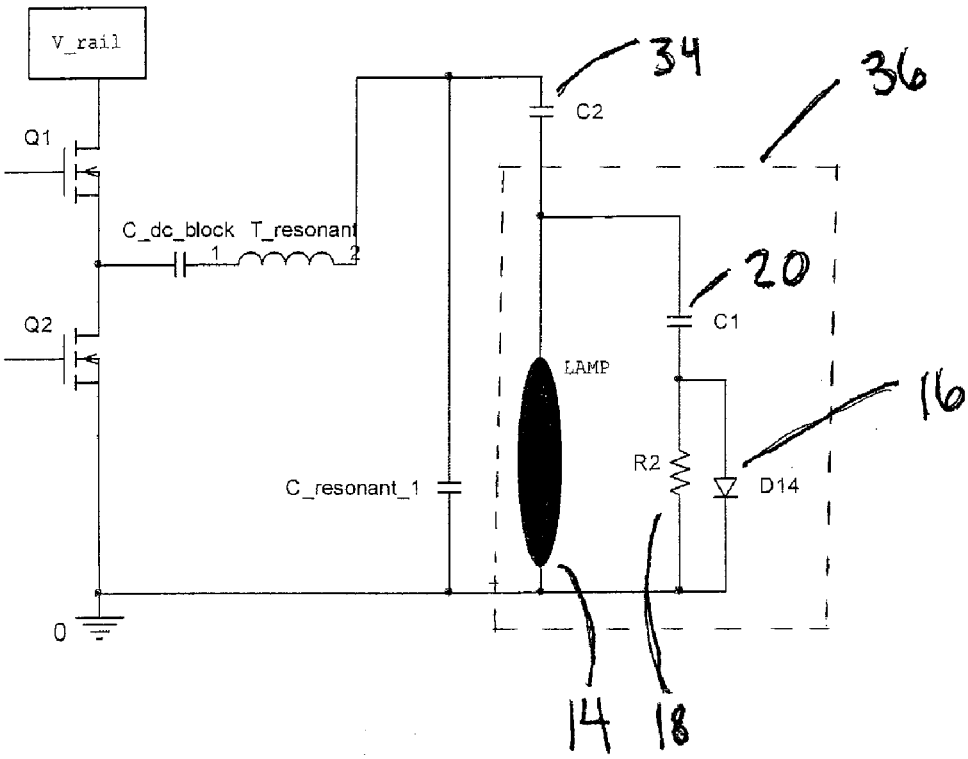
FIG. 6 is a schematic drawing of yet another embodiment of the present invention.

Also during the interval between A1 and C the capacitor 20 will begin to discharge through the lamp 14 and the resistor 18. The capacitor 20 discharges through the lamp 14 and resistor 18 because the diode 16 is no longer conducting, essentially presenting an electrical open, and the charged capacitor 18 has no other discharge outlets. The period during which the capacitor 18 discharges is referred to as the second portion of the periodic lamp current. The discharge through the lamp 14 is illuminated by the comparison between waveforms 26 and 30. The current added by the capacitive discharge waveform 28 to waveform 26 results in waveform 30, which has an increased frequency content when compared to waveform 26. As previously mentioned with respect to the interval between A and A1, some degree of variation in the occurrence of the events in and around the interval between A1 and C is expected. The sequence described above will repeat as long as the ballast and lamp continue to operate. It should also be noted that the intervals associated with the charging and discharging of the capacitor 20 may change given the orientation of the diode 16, as shown in FIG. 6. However, regardless of this alternate diode 16 orientation, the invention will still function to eliminate or reduce striations.

The increased frequency content in waveform 30 is a direct consequence of the change to the shape of waveform 26, i.e. waveform 30 is less sinusoidal. In fact, waveform 30 is almost a square wave. Square waves are known in the art to have a wider frequency spectrum than sinusoids (simply, each sinusoid in the time domain correlates to a frequency in the frequency domain and square waves are composed of multiple sine waves—consequently, square waves have a wider frequency spectrum than do sinusoids). Resultantly, the system reduces and/or eliminates striations because it spreads the striation-inducing events over a wider frequency envelope than does the non-capacitively compensated lamp current waveform 26.

It should also be noted that because the capacitor 20 is a finite charge repository (no matter how much current is supplied to the capacitor 20, it will only be able to charge to a certain level, i.e. store a limited number of electrons), the greatest capacitive energy compensation impact will occur at low lamp current levels. As the current demanded by the lamp 14 increases the method of the invention will have less pronounced effects. The effects of the method can be tailored to suit different applications, i.e. different lamps, ballasts, operating conditions, etc., by adjusting the values of the capacitor 20 and resistor 18, among others.

A low frequency blocking filter 34 may be coupled to the lamp 14 and the capacitor 20 to prevent further DC current from entering the lamp 14 as shown in FIGS. 5 and 6. Desirably, the blocking filter 34 would be connected in electrical series with the lighting circuit 36. In one embodiment the blocking filter 34 would be a capacitor 34.

Thus, although there have been described particular embodiments of the present invention of a new and useful method and system to eliminate fluorescent lamp striations by using capacitive energy compensation, it is not intended that such references be construed as limitations upon the scope of this invention except as set forth in the following claims.

What is claimed is:

1. A method of eliminating striations in a fluorescent lamp powered by an electronic ballast which generates a periodic lamp current to operate the lamp, wherein the lamp has a predetermined lamp voltage condition, comprising:

providing a capacitive energy circuit in parallel electrical connection with the lamp, the capacitive energy circuit further comprising a resistive element and a capacitive energy source coupled to the resistive element;

activating a switch, said switch in parallel electrical connection with the resistive element, when the predetermined lamp voltage condition is present so that the capacitive energy circuit charges during a first portion of the periodic lamp current; and deactivating the switch when the predetermined lamp voltage condition is absent so that the capacitive energy circuit discharges through the lamp during a second portion of the periodic lamp current.

2. The method of claim 1 wherein during the second portion of the periodic lamp current the capacitive energy source discharges through the lamp and the resistive element.

3. The method of claim 1 wherein the capacitive energy circuit comprises a capacitor.

4. The method of claim 3 wherein the switch comprises a diode.

5. The method of claim 1, wherein the switch and resistive element coupled in parallel define a first circuit and the capacitive energy source is in electrical series with the first circuit.

6. The method of claim 5 wherein the capacitive energy source, the switch, and the resistive element define a striation reduction circuit and the striation reduction circuit is in parallel electrical connection with the lamp.

7. The method of claim 6 further comprising:

passing lamp signals through a low frequency blocking filter coupled to the lamp and the capacitive energy source.

8. An electronic ballast for a lamp, the lamp having a predetermined signal event, comprising:

a capacitive energy circuit in parallel electrical connection with the lamp, the capacitive energy circuit further comprising a resistive element and a capacitive energy source coupled to the resistive element; and a switch in parallel electrical connection with the resistive element, the switch being responsive to the predetermined signal event so that the switch allows the capacitive energy circuit to discharge through the lamp according to the predetermined signal event.

9. The ballast of claim 8 wherein the resistive element and switch coupled in parallel define a switching circuit and the capacitive energy source is in electrical series with the switching circuit.

10. The ballast of claim 9 wherein the resistive element, the switch, and the capacitive energy source define a striation reduction circuit and the striation reduction circuit is in parallel electrical connection with the lamp.

11. The ballast of claim 10 wherein the striation reduction circuit and the lamp define a lighting circuit, the ballast further comprising:

a low frequency blocking filter connected in electrical series with the lighting circuit.

12. A method of eliminating striations in a lamp powered by an electronic ballast, the lamp having a predetermined lamp voltage condition, comprising:

charging a capacitive energy device, coupled in parallel with the lamp, when the predetermined lamp voltage condition is satisfied, said capacitive energy device comprising a capacitor, a diode and a resistor in parallel electrical connection with the diode; and supplementing current supplied to the lamp by the electronic ballast with current supplied from the capacitive energy device when the predetermined lamp voltage condition is not satisfied.

13. The method of claim 12 wherein the resistor and the diode define a switching circuit and the capacitor is in electrical series with the switching circuit.

14. The method of claim 13 wherein the step of charging the capacitive energy device comprises:

forward biasing the diode so that the capacitor may charge.

15. The method of claim 14 wherein the step of supplementing the current supplied to the lamp comprises:

discharging the capacitor through the lamp and the resistor.

16. The method of claim 12 further comprising:

passing lamp signals through a low frequency blocking filter coupled to the lamp and the capacitive energy device.

17. The method of claim 16 wherein the low frequency blocking filter comprises a capacitor.

* * * * *